US009138034B2

(12) United States Patent
Donnadieu et al.

(10) Patent No.: US 9,138,034 B2
(45) Date of Patent: Sep. 22, 2015

(54) REMOVABLE END PIECE FOR A POLE AND A POLE EQUIPPED WITH SUCH AN END PIECE

(71) Applicant: SALOMON S.A.S., Metz-Tessy (FR)

(72) Inventors: Thierry Donnadieu, Sillingy (FR); Eric Girault, Annecy (FR)

(73) Assignee: SALOMON S.A.S., Metz-Tessy (FR)

( * ) Notice: Subject to any disclaimer, the term of this patent is extended or adjusted under 35 U.S.C. 154(b) by 0 days.

(21) Appl. No.: 14/168,557

(22) Filed: Jan. 30, 2014

(65) Prior Publication Data

US 2014/0209134 A1 Jul. 31, 2014

(30) Foreign Application Priority Data

Jan. 31, 2013 (FR) ..... 13 00206

(51) Int. Cl.
*A63C 11/24* (2006.01)
*A45B 9/04* (2006.01)
*A63C 11/22* (2006.01)

(52) U.S. Cl.
CPC ..... *A45B 9/04* (2013.01); *A63C 11/227* (2013.01); *A63C 11/24* (2013.01)

(58) Field of Classification Search
CPC ..... A63C 11/22; A63C 11/24
USPC ..... 135/77; 280/824
See application file for complete search history.

(56) References Cited

U.S. PATENT DOCUMENTS

| | | | | | |
|---|---|---|---|---|---|
| 2,721,084 | A * | 10/1955 | Weiss | ..... | 280/824 |
| 3,151,875 | A * | 10/1964 | Marchand | ..... | 280/824 |
| 3,202,436 | A * | 8/1965 | Barreea | ..... | 280/824 |
| 3,582,100 | A * | 6/1971 | Allsop | ..... | 280/821 |
| 3,825,275 | A * | 7/1974 | Klemm | ..... | 280/823 |
| 4,316,620 | A * | 2/1982 | Wien | ..... | 280/824 |
| 4,669,752 | A * | 6/1987 | Jackson et al. | ..... | 280/824 |
| 6,203,064 | B1 * | 3/2001 | Zaltron | ..... | 280/824 |
| 6,390,109 | B1 | 5/2002 | Manninen | | |
| 7,322,612 | B2 | 1/2008 | Trinen et al. | | |
| 8,505,975 | B2 | 8/2013 | Karlof | | |
| 8,851,094 | B2 * | 10/2014 | Kuma | ..... | 135/77 |
| 2011/0018250 | A1 * | 1/2011 | Lenhart | ..... | 280/824 |
| 2011/0084472 | A1 * | 4/2011 | Karlof et al. | ..... | 280/824 |
| 2013/0264809 | A1 * | 10/2013 | Carr | ..... | 280/821 |

FOREIGN PATENT DOCUMENTS

| | | | | | |
|---|---|---|---|---|---|
| CH | 249800 | * | 7/1947 | ..... | A63C 11/24 |
| DE | 43 14 173 | A1 | 11/1994 | | |
| EP | 0 906 776 | A1 | 4/1999 | | |
| EP | 1 025 883 | A2 | 8/2000 | | |
| EP | 1676608 | A1 * | 7/2006 | ..... | A63C 11/24 |
| EP | 2 308 570 | A2 | 4/2011 | | |
| JP | S49-25881 | Y1 | 7/1974 | | |
| JP | S52-10458 | Y2 | 3/1977 | | |

* cited by examiner

*Primary Examiner* — Noah Chandler Hawk
(74) *Attorney, Agent, or Firm* — Greenblum & Bernstein, P.L.C.

(57) ABSTRACT

An end piece for a pole and a pole including such end piece, the end piece including a basket including a housing for receiving a distal end of a shaft of the pole, as well as a locking ring for surrounding at least a portion of the housing. The housing is demarcated by a wall supporting at least one catch provided, at a first end, with a nub configured to extend within the housing, the catch being capable of assuming a plurality of configurations corresponding to various radial positions of the nub. The ring is shaped to limit the radial displacement of the first end of the catch outward of the housing when the ring is assembled to the basket.

35 Claims, 7 Drawing Sheets

REMOVABLE END PIECE FOR A POLE AND A POLE EQUIPPED WITH SUCH AN END PIECE

CROSS-REFERENCE TO RELATED APPLICATION

This application is based upon French patent application Ser. No. 13/00206, filed Jan. 31, 2013, the disclosure of which is hereby incorporated by reference thereto in its entirety, and the priority of which is claimed under 35 U.S.C. §119.

BACKGROUND

1. Field of the Invention

The invention relates to the field of poles, such as poles configured for use during skiing, as well as for use while walking or running. In more particularity, the invention relates to a removable end piece for a pole of the aforementioned type, as well as to a pole provided with such a removable end piece.

2. Background Information

Poles adapted for skiing, walking, or running provide the user with stability, with support for the arms in order to relieve the legs, and/or with the ability to generate more push-off power, for example.

Poles of the aforementioned type typically comprise a shaft having a handle at one end and an end piece at the other end. The end piece is adapted to take support on the ground and/or to penetrate into the ground.

To optimize the effectiveness of the pole, the end piece must be adapted to the type of force that is generated and/or to the type of terrain. In the case of cross-country skiing, for example, it is advantageous to use an end piece adapted to the consistency of the snow, in particular its hardness. In the case of walking, for example, it is usually advantageous to use a metallic end piece adapted to penetrate into the ground to improve the stability of the walker. However, such metallic end pieces tend to score the rock and are forbidden in certain areas.

Furthermore, an end piece can be multi-purpose by enabling mixed winter/summer operation. In this case, because of the varying nature of the ground, the support required for the pole is not the same. Therefore, it is necessary to be able to easily change the end piece on the pole.

Therefore, poles having removable and interchangeable end pieces, to optimize their effectiveness, have been proposed.

The patent document EP 2308570 and family member U.S. Pat. No. 8,505,975 disclose a solution that provides a pole comprising a pole body receiving a locking ring and an end piece, or basket. The pole body includes a recessed portion near its lower end. The basket includes a split fastening hub receiving the pole body. The cylindrical interior of the fastening hub is provided with slight annular projections adapted to be housed in the recessed portion of the pole body when the basket is assembled to the pole body.

The locking ring is screwed onto the fastening hub of the basket so as to tighten the latter on the pole body. Accordingly, the projections are maintained in the recessed portion of the pole body. This cooperation ensures the axial retention of the basket on the pole body.

To ensure rotational connection of the two elements, the pole body comprises a transverse slot at its lower end for housing a transverse protuberance provided at the bottom of the fastening hub of the basket. This interlocking enables the basket to be indexed in relation to the pole body and to block any relative rotation between these two elements about the axis of revolution of the pole body.

Although satisfactory overall, this solution has a plurality of drawbacks. In particular, it has been found that the tightening may loosen or become insufficient during use, due to the impacts and the forces transmitted by the user. The end piece can then separate from the pole body. Similarly, a translation of the end piece can cause the end piece indexing in relation to the pole body to be lost, thereby resulting in an impediment for the supports and/or a sharp decline in the effectiveness of the pole.

To solve this problem, especially during competition, certain users adhesively attach the end piece to the pole, which prevents separation but also any subsequent interchangeability of the end piece.

Other users overly tighten the ring on the end piece to avoid accidental loosening, which often causes the ring to rupture.

SUMMARY

The invention provides a pole with an improved removable end piece.

The invention especially improves the connection of the end piece with the pole shaft.

Further, the invention provides an end piece that is robust and is easy to assemble and to interchange on the shaft of the pole.

Still further, the invention secures the mechanism for affixing the end piece to the shaft of the pole.

According to an embodiment, the invention provides an end piece for a pole, including a basket comprising a housing configured to receive a distal end of the pole shaft and a locking ring configured to surround at least a portion of the housing. Moreover, the housing is demarcated by a wall supporting at least one catch provided at a first end with a nub configured to extend within the housing, the catch being capable of assuming a plurality of configurations corresponding to various radial positions of the nub. The ring is shaped to limit the radial displacement of the first end of each catch outward of the housing when the locking ring is assembled on the basket.

Thus, the ring prevents the outward displacement of each catch, thereby retaining each nub within the housing. However, each nub is configured to cooperate with a retaining surface provided on the shaft, as long as each nub remains within the housing. Consequently, in this configuration, each nub ensures the retention of the basket on the shaft. Thus, fixing the end piece onto the shaft is made more reliable while being simple to carry out.

According to an embodiment, each nub comprises at least one lateral rotational stop surface.

According to an alternative embodiment, each nub comprises two lateral rotational stop surfaces. The lateral rotational stop surfaces of each nub ensure simple and precise angular indexing of the basket on the shaft. However, the angular positioning is particularly important, especially when the handle of the shaft is to be oriented angularly in relation to the end piece along the longitudinal axis of the pole. This is the case in cross-country skiing, in which the end piece bears an asymmetrical support surface adapted to limit the penetration of the pole into the ground and to increase the support points during the pushing phases. However, during use, the support surface should not block the pivoting of the pole about the tip during the pushing phase. Therefore, the asymmetrical support surface and the handle are required to be angularly indexed in order not to disturb the skier's movement.

Another aspect of the present invention relates to a pole equipped with at least one end piece according to the invention.

The pole comprises a shaft having at least one retaining surface, such as an opening or a recess, with which each nub is configured to cooperate to ensure retention of the basket on the shaft.

According to another embodiment, the present invention provides an end piece for a pole, which is adapted to be removably attached to a pole shaft, the end piece comprising:

- a basket including a housing configured to receive a distal end of the shaft;
- a locking ring configured to surround at least a portion of the housing.

The housing is demarcated by a wall supporting at least one catch provided with a nub, the catch being capable of assuming a plurality of configurations corresponding to various radial positions of the nub. The end piece is shaped so that, in at least one of these positions, each nub extends within the housing to penetrate into a retaining surface carried by the shaft, in order to at least partially retain the basket on the shaft. The ring is shaped to limit the radial displacement of each catch outward of the housing when the locking ring is assembled on the basket.

Another aspect of the present invention relates to a pole shaft, configured to removably receive the end piece according to the invention, the shaft comprising at least one complementary retaining surface for each nub, the shaft being shaped to restrain or retain the end piece when each retaining surface cooperating with each nub.

Another aspect of the present invention relates to an assembly comprising a shaft according to the invention and at least one end piece according to the invention. Another aspect of the present invention relates to a shaft according to the invention and a set of end pieces according to the invention.

BRIEF DESCRIPTION OF DRAWINGS

The purposes, objects, as well as the characteristics and advantages of the invention will be more apparent from the following detailed description of an embodiment thereof, illustrated by the following annexed drawings, in which.

DETAILED DESCRIPTION

Figure 1:
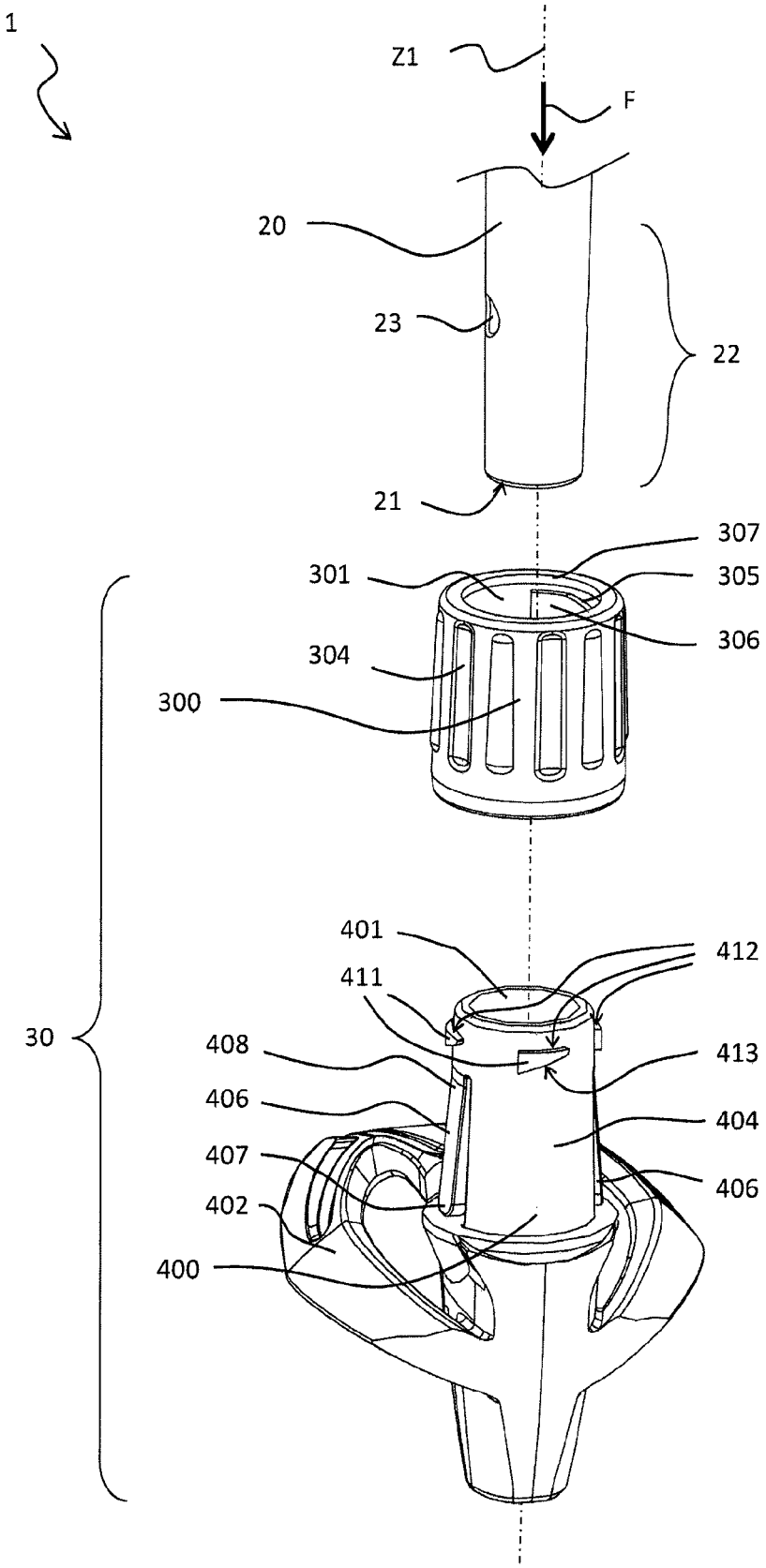
FIG. 1 is a perspective view of a portion of the pole shaft, ring and basket according to an embodiment of the invention, these three elements being separated from on another.

The drawings are provided by way of examples and are not limiting to the invention. The drawings are schematic diagrams intended to facilitate an understanding of the invention and are not necessarily to scale for practical applications. In particular, only a portion of the length of the shaft is shown in the drawing figures.

Prior to a detailed review of the embodiments of the invention, optional features that can possibly be used in combination or as alternatives are set out below.

According to an embodiment, the wall of the housing of the basket defines an outer envelope and, when at rest, i.e., when not biased, the first end of each catch projects from the outer envelope of the wall. Thus, during positioning of the ring on the basket, the ring presses on each catch and causes a radial displacement of each nub inward of the housing to ensure that the end piece and the pole are affixed to one another.

According to an embodiment, each nub, when at rest, projects within the housing, by a height less than 3.0 mm in a particular embodiment, and by a height less than 2.0 mm in another. Thus, even in the absence of bias, each nub extends at least partially into the housing. The shaft then comes into contact with the nubs when it is inserted into the housing. When each nub is positioned in relation to each associated retaining surface provided on the shaft, typically a recess or a hole, each nub cooperates with an associated retaining surface. The positioning of the basket on the shaft is thus carried out correctly. The displacement of each nub in each retaining surface indicates to the user that this positioning is correct. This solution enable a blind positioning, whereby the user can easily feel or hear each nub being housed in each associated retaining surface. Moreover, a slight penetration within the housing allows for an easier disengagement of each nub from each associated retaining surface of the shaft, as soon as the basket is displaced. Thus, damage to each nub is avoided when the basket separates from the shaft. To facilitate this disengagement, each nub may be rounded or sloped in its portion projecting inside the housing, when at rest. For example, the end of each nub may form a spherical portion, a cone, or a pyramid. It is therefore important to find the right compromise between the perception of correct positioning of the basket on the shaft and the assistance to the disengagement of each nub from each associated retaining surface of the shaft, when dismounting the end piece. It is the engagement height of each nub at rest that makes it possible to adjust this compromise.

According to an embodiment, the end piece is configured so that the distal end of the shaft is inserted into the housing by a displacement comprising at least one translational component. Each catch is in the form of a tongue, a first end of which supports the nub and is arranged, in relation to a second end connected to the wall, downstream along the direction of insertion of the distal end into the housing. This makes it easy to insert the shaft into the basket without damaging the catch or catches projecting within the housing. Indeed, as and when the shaft is being inserted in the housing, the distal end of the shaft pushes the catch or catches outward of the housing. In the reverse configuration (first end of each catch upstream of the second end), the distal end of the shaft comes into direct contact with the first end of each catch while the latter projects in the housing and therefore abuts on this first end. The risk of damage to each catch by the shaft is therefore substantial.

This configuration has an additional advantage. Indeed, the end piece is configured so that the ring is inserted onto the basket via a displacement comprising at least one translation. The downstream positioning of each first end supporting a nub allows easy insertion of the ring onto the basket without damaging the catch or catches which project on the outer envelope of the basket wall. The principle is the same as that described above for the insertion of the shaft into the housing.

As and when the ring is being inserted onto the basket, the ring pushes the catch or catches inward of the housing. In the reverse configuration (first end of each catch upstream of the second end), the ring comes into contact with the first end of each catch, while the latter projects outward and therefore abuts on each first end. The risk of damage to each catch by the ring is therefore substantial.

According to an embodiment, each catch is fixed to the wall demarcating the housing and is deformable to be able to assume multiple configurations corresponding to various radial positions of each nub, when the catch is biased. The biasing of each catch, for example via the inner bore of the locking ring, thus makes it possible to push each nub within the housing.

According to an embodiment, each catch forms a one-piece element with the wall demarcating the housing. This simplifies the manufacture of the end piece and makes the basket stronger, more robust.

According to an embodiment, each catch is elastic, and the end piece is shaped so that each nub moves radially in relation to the axis of revolution of the shaft, under the effect of the elasticity of the catch, outward of the housing when the ring is removed from the basket. Thus, once the ring is removed, each catch, and therefore each nub, moves outward of the housing and, for example, may return to a rest configuration in which each nub only slightly cooperates with each associated retaining surface, thereby enabling the basket to be easily dismounted from the shaft. This makes possible a tool-free removal of the basket.

According to an embodiment, each catch is rotationally hinged on the wall defining the housing so as to be capable of assuming a plurality of configurations corresponding to various radial positions of each nub.

According to an embodiment, the end piece is configured so that when the locking ring is assembled on the basket, the locking ring presses on each catch so as to radially displace the first end of each catch supporting each nub inward of the housing.

According to an embodiment, the end piece comprises an axial locking mechanism configured to limit the relative axial displacement between the basket and the locking ring, the locking mechanism being activated by a relative rotation between the two elements. The mechanism makes it possible to prevent axial separation of the ring from the basket.

Alternatively, the axial locking mechanism comprises at least a first surface carried by the basket and at least a second surface carried by the ring, at least one of the first and the second surfaces being shaped so that the cooperation of the first and second surfaces generates a translational displacement of the ring in relation to the basket, when the ring is rotated about the basket. Typically, the first and second surfaces form a screw thread or a screw thread portion.

Alternatively, the axial locking mechanism is configured to provide axial locking via a relative rotation, having an angle less than 180° and, in a particular embodiment, an angle equal to or less than 90°, between the ring and the basket.

This locking is obtained in a particularly easy and quick fashion, even under conditions in which manipulation is made difficult.

According to an embodiment, the end piece comprises a rotational locking mechanism for limiting the relative rotation between the basket and the ring, when the end piece is assembled, that is to say, when the ring is positioned on the basket comprising a rotation. This mechanism makes it possible to avoid unintentional rotation of the ring in relation to the basket, and therefore reduce the risk of ill-time separation. Moreover, when the ring is effectively locked on the basket, this locking mechanism forms a reference mark, such as a visual reference mark, that enables the user to ensure that the locking is correct.

According to an embodiment, the ring is positioned on the basket, via relative axial translation between the two elements, only for one or certain specific predetermined angular orientations between the two elements. In this regard, the end piece includes an angular indexing mechanism that enables rapid and correct positioning of the ring in relation to the basket before assembly. Such fool-proofing automatically ensures the angular positioning of the ring in relation to the basket, thus guaranteeing correct operation of the axial and/or rotational locking mechanism.

Alternatively, the angular indexing mechanism is configured such that the ring can be inserted onto the basket only for a given angular orientation of the ring in relation to the basket.

According to an embodiment, the wall has a shape substantially complementary to an outer surface of the distal end of the shaft. Typically, this wall has a substantially circular shape.

According to an embodiment, a second end of each catch, opposite the first end supporting the nub, is arranged on the wall downstream along the direction of insertion of the distal end of the shaft into the housing.

Alternatively, the housing wall forms a closed ring in the area of the end of the housing downstream along the direction of insertion of the distal end of the shaft into the housing.

According to an embodiment, the housing forms a portion of a hole extending through the basket, along its longitudinal axis.

Alternatively, each retaining surface has a recess or an opening into which each associated nub is configured to penetrate, at least partially, to ensure the retention of the basket on the shaft.

According to an embodiment, the pole comprises a shaft having a continuous and progressive variation of the cross section on a portion of the length of the shaft extending from the distal end of the shaft. Indeed, the invention does not require the shaft to have a recessed cross section at a specific distance from the distal end to ensure reliable retention of the end piece. However, the known solutions practically provide a shaft whose cross section widens to form a surface for retaining the end piece in order to reduce the risk of losing of the end piece. Alternatively, the cross section may be constant, at least at the distal end of the shaft. In this case, the invention makes it possible to rationalize the method for manufacturing poles from shafts of identical lengths, and in order to manufacture poles of different lengths. Indeed, the invention makes it possible to manufacture shafts of identical lengths, and then to adjust the length of the shafts by cutting them as a function of the size of the users. The openings or recesses are then made in the shaft, all at the same distance from the distal end. A full range of varied pole lengths can thus be obtained from shafts all having the same length.

A particular non-limiting embodiment of the invention is described below with reference to FIGS. 1-7, which show a pole configured more particularly for the practice of cross-country skiing.

The pole 1 comprises a handle (not shown), a shaft 20, and an end piece 30. In this exemplary embodiment, the end piece 30 comprises a ring 300 and a basket 400. For example, a handle can be any of those disclosed in U.S. Pat. No. 7,322,612, the disclosure of which is hereby incorporated by reference thereto in its entirety.

The shaft 20 has a proximal end (not shown) typically associated with a handle configured to be grasped by the user, as well as a distal end 21 configured to be affixed to the end piece 30.

The shaft 20 or at least a portion 22 of the shaft 20, extending from the distal end 21, extends along a longitudinal direction designated by the reference numeral Z1 in the drawing figures. The ring 300 and the basket 400 are inserted onto the shaft 20 via a movement comprising at least one translation occurring along the longitudinal direction Z1. In the following description, the term radial or transverse direction refers to directions perpendicular to the longitudinal direction Z1.

The basket 400 includes a housing 401 within which the end of the shaft 20 is configured to be inserted. The housing 401 is affixed to a zone adapted to come into contact with the ground, typically snow, soil, or stones. In the case in which the end piece is intended for use in snow or on loose ground such as sand, gravel, or mud, the zone adapted to come into contact with the ground comprises, for example, a rounded cup-shaped part 402, i.e., such as an inverted cup-shaped part, hereafter referred to as a cup, configured and shaped to limit the penetration of the pole 1 into the ground. According to an embodiment, the cup 402 forms a one-piece element with the housing 401. In addition or alternative to the presence of the cup 402, the end piece comprises an end member, such as in the form of a point or peak, for example, arranged at an end of the basket 400 opposite the inlet of the housing 401. The end member is adapted to penetrate into the ground. In one embodiment, the end member is attached on the basket 400 and is made of metal, for example. In the example illustrated in FIGS. 1-7, a cavity 403 is provided in the basket 400 to receive the end member (not shown). Alternatively, the end member defines a one-piece element with the basket 400. The basket 400 may be made of plastic, carbon, or metal, for example. The end member can be attached on the latter. If made of metal, the end member can particularly have good resistance to wear.

Alternatively, the end piece includes no end member and/or no washer or cup. For Nordic walking, for example, one could have only one end piece made of rubber, which must be oriented. In addition, the basket may not have a washer- or cup-like widened shape.

According to another alternative embodiment, the basket 400 supports a cup 402, or cup-shaped part, but no end member. For example, the basket can include a hole extending through the element along its longitudinal axis. In this case, the housing 401 is not blocked and extends to open out in the lower portion of the basket. Alternatively, the housing 401 may substantially form a cylinder open on both sides. An axial stop device can be provided to limit the relative displacement between the basket and the shaft. For example, the axial stop device may be a ring affixed to the shaft cooperating with a portion of the basket. According to another example, the axial stop device can be a simple inner collar of the housing 401 against which the end of the shaft takes support. With this embodiment, the end member may be fixed directly to the shaft rather than to the basket. This makes it possible to independently change the basket or the end member when worn.

The housing 401 is demarcated by a wall 404 having a circular, e.g., outer surface and an inner surface 405 of the housing 401 complementary to the outer surface of the distal end 21 of the shaft. In such a case, the inner surface 405 is also circular or slightly truncated. The wall 404 forms a sleeve for the distal end portion 22 of the shaft 20. The housing 401 of the basket 400 bears at least one catch 406 and, in the example described, two catches arranged symmetrically in relation to the longitudinal axis of the housing 401, as illustrated in the non-limiting embodiment of FIGS. 1-7. The basket may include more catches.

For simplification, in the following description reference will be made to a single catch, it being understood that the characteristics of such catch also apply to any other catches.

The catch 406 has a first end 407, that is, a distal or free end, provided with a radial nub 409, or projection, and a second end 408, that is, a proximal or connected end, that is, connected to the wall 404 defining the housing 401. In the illustrated exemplary embodiment, the catch 406 forms a tongue, or is in the shape of a tongue, extending length-wise between the second and first ends 408, 407. As can be seen in FIG. 1, for example, the catch 406 extends within an opening of the basket. The basket 400 is configured such that the first end 407 can be displaced radially, meaning that it can be moved towards or away from the interior of the housing 401. Typically, the first end 407 is pivotable about an axis substantially perpendicular to the longitudinal direction Z1 and passing, for example, substantially through the second end 408.

In the example illustrated in the drawing figures, the second end 408 is affixed to the wall 404 defining the housing 401. It forms a one-piece element with the latter. Thus, the proximal end of the housing 401 forms a ring from which the catch 406 extends, in a direction toward the distal end of the housing 401. The radial displacement of the first end 407 is then obtained by elastic deformation of the catch 406. Alternatively, the catch 406 can be separate from the wall 404 and rotationally hinged thereon. As shown in the drawings of the illustrated embodiments, the ring of the proximal end of the housing is a continuous ring that has a continuous upper edge for receiving the distal end portion 22 of the shaft.

In this example, in the vicinity of the first end 407 the catch 405 has a nub 409, or protuberance, that faces inward of the housing 401. The shaft 20 comprises, in its end portion 22 configured to be inserted into the housing 401, at least one retaining surface 23 configured to cooperate with the nub 409. The shaft 20 is shaped so that, for at least one angular position about the longitudinal direction Z1, when the shaft 20 is inserted into the basket 400, the nub 409 cooperates with the associated retaining surface 23 to prevent, or at less to oppose, the separation of the basket 400 in relation to the shaft 20.

According to an embodiment, the retaining surface forms a hollow, a recess, or an opening 23. If the shaft is solid, the retaining surface may be either a hollow or a through opening extending through the shaft. If the shaft forms a tube, each retaining surface forms, for example, a retaining surface opening 23 extending through the thickness of the shaft 20. It is this non-limiting embodiment that is illustrated in the drawing figures.

Figure 5:
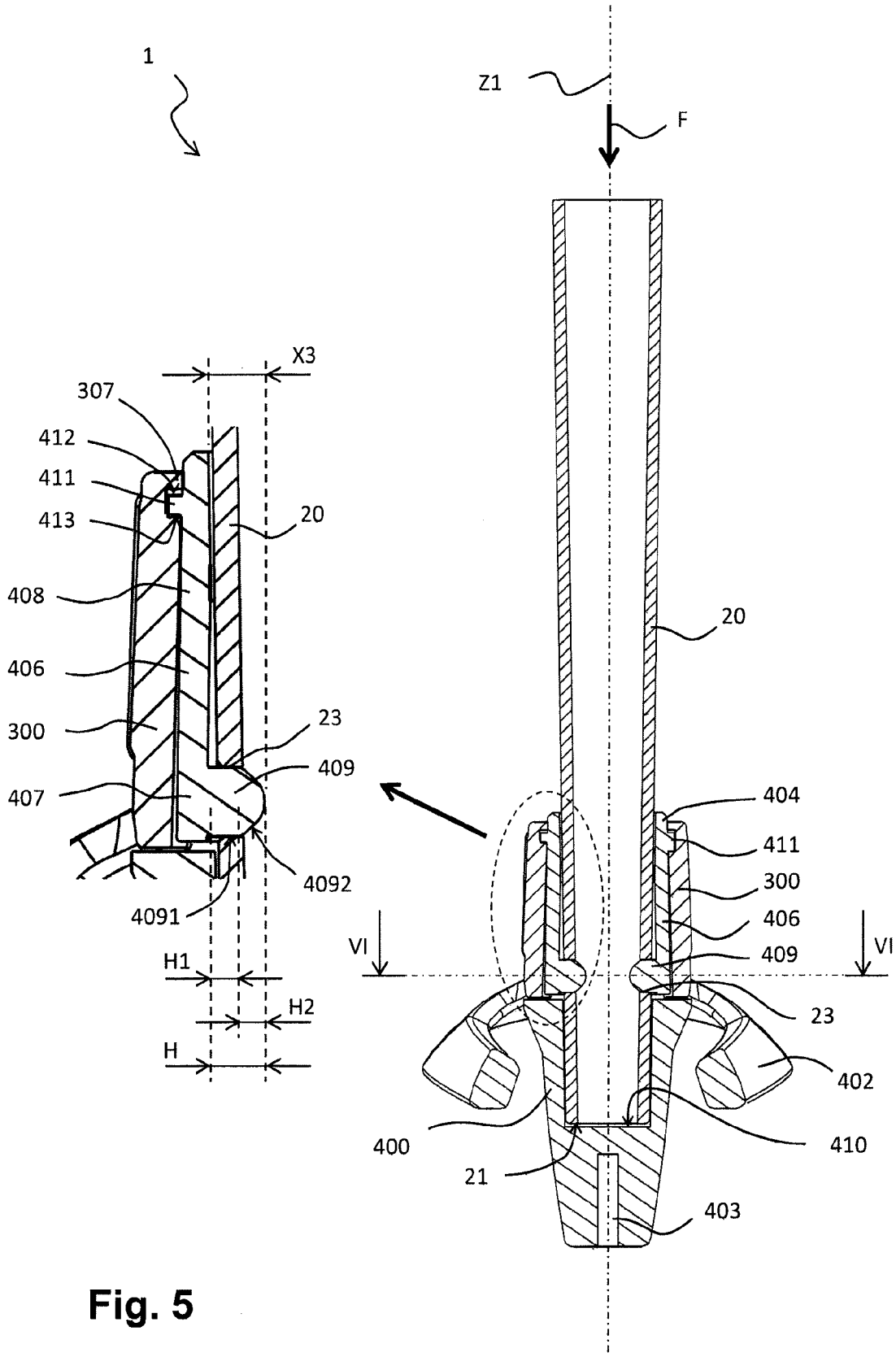
FIG. 5 is a cross-sectional view of the three elements illustrated in FIG. 1, in which the end piece is shown in the locked position on the shaft.
Figure 6:
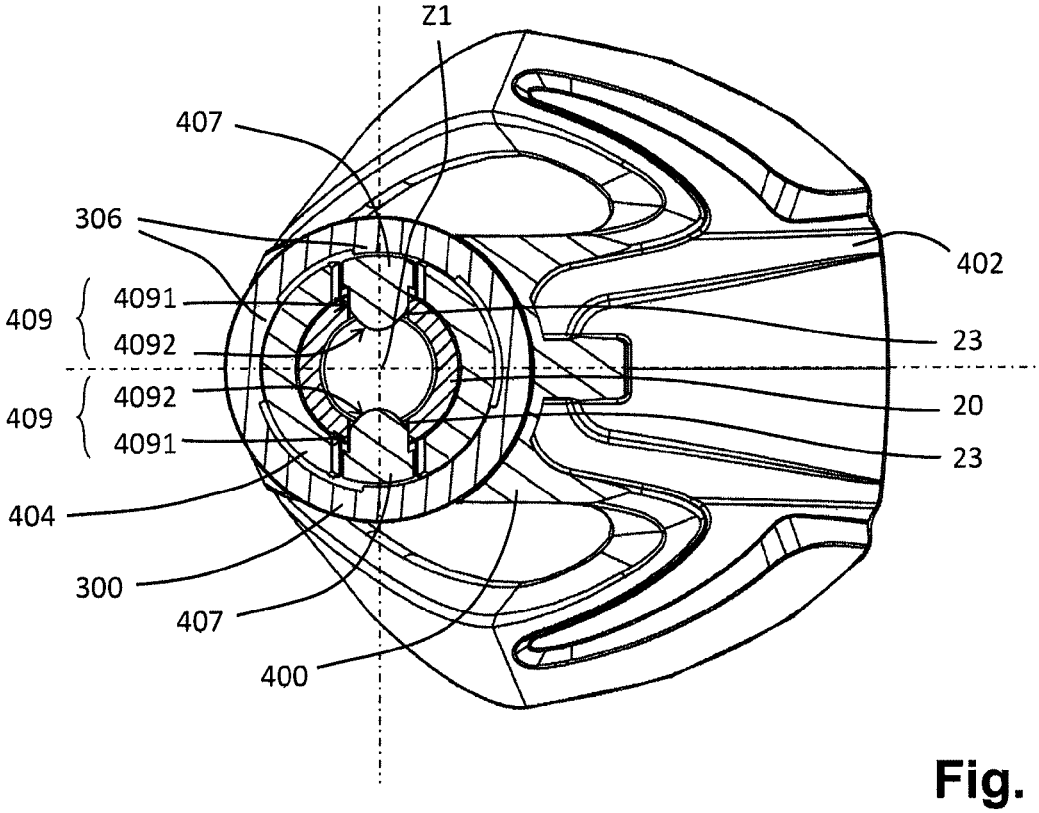
FIG. 6 is a cross-sectional view along the line VI-VI of FIG. 5.
Figure 7:
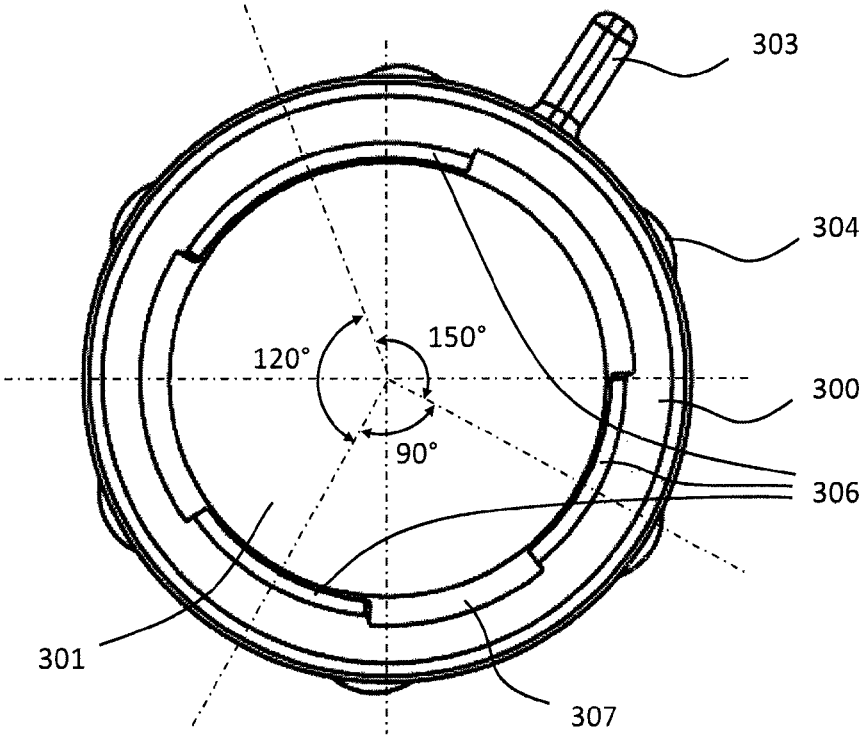
FIG. 7 is a bottom view of the ring alone.

Typically, as depicted in FIG. 5, e.g., the nub 409 may have the shape of a stud, having a height H, extending radially in relation to the axis of the basket 400, from the first end 407 of the catch 406 inward of the housing 401. The nub can comprise two portions. A first portion 4091, including an upper surface, a lower surface, and two lateral surfaces, extend over a first height H1 from the first catch 406. The first portion can form a parallelepipedic portion or a cylindrical portion. In the example illustrated, the nub comprises a cylindrical portion 4091. In this case, it is considered that the upper, lower, and lateral surfaces are formed by portions of the outer surface of the cylinder forming the cylindrical portion 4091. A second portion forms a head 4092 of the nub 409 and extends over a second height H2. The nub head advantageously forms a spherical portion, a cone, or a pyramid. The dimensions of the nub head 4092 and of the first portion 4091 are selected so that the nub head and at least a portion of the first portion can penetrate into the opening 23.

In the example shown, the housing 401 has an axial stop 410 against which the distal end 21 of the shaft 20 is configured to take support. The shaft 20 and the basket 400 are sized such that when the distal end 21 is supported on the axial stop 410, the opening 23 is then positioned in relation to the nub 409. Thus, the distance between the axial stop 410 and the nub 409 is substantially equal to the distance between the distal end 21 and the opening 23. Advantageously, the axial stop 410 is formed by the bottom of the housing 401, which simplifies the structure and increases the strength of the basket 400.

In the exemplary embodiment, the pole 1 is configured so that, when the shaft 20 is supported on the axial stop 410 and the nub 409 is at least partially inserted into the opening 23, the pressure forces applied from the shaft 20 to the ground or the basket 400 pass directly through the distal end 21 of the shaft 20 and the axial stop 410 of the basket 300. This can be achieved by even a small axial clearance between the opening 23 and the nub 409 when the distal end 21 of the shaft 20 is supported on the axial stop 410. Thus, the nub 409 and the opening 23 are not biased, or are only slightly biased, if downward pressure is applied to the pole 1. This feature is advantageous because, during use, the poles 1 may be subject to considerable pressure forces, especially when used during the pushing phases in cross-country skiing.

In other words, the retention of the end piece on the shaft, following relative axial movements of the basket 400 and the shaft 20 to bring them closer together, is a direct result of the contact between the distal end 21 and the axial stop 410. For the practice of cross-country skiing in particular, this force take-up is the most substantial because it corresponds to thrust/pushing forces exerted on the pole.

Conversely, the retention of the end piece 30 on the shaft, following a relative axial spacing between the basket 400 and the shaft 20, results from the contact between the nub 409 and the opening 23.

For the practice of cross-country skiing in particular, this force take-up is significantly less substantial than during pushing. The need for strength is less than when biasing the pole during pushing.

The ring 300 has a through opening 301 shaped to surround the wall 404 defining the housing 401 of the basket 400. The opening 301 has an inner cross section complementary to the outer surface of the wall 404 of the basket 400, so as to be capable of being connected, at least partially, onto the basket 400 via a movement comprising at least one translational component along the longitudinal direction Z1 in the insertion direction F.

According to an alternative embodiment, the ring 300 is screwed onto the basket 400.

According to the illustrated exemplary embodiment, the assembly of the end piece is described below.

Initially, the ring 300 is inserted onto the shaft 20, on the distal end portion 22.

Figure 4:
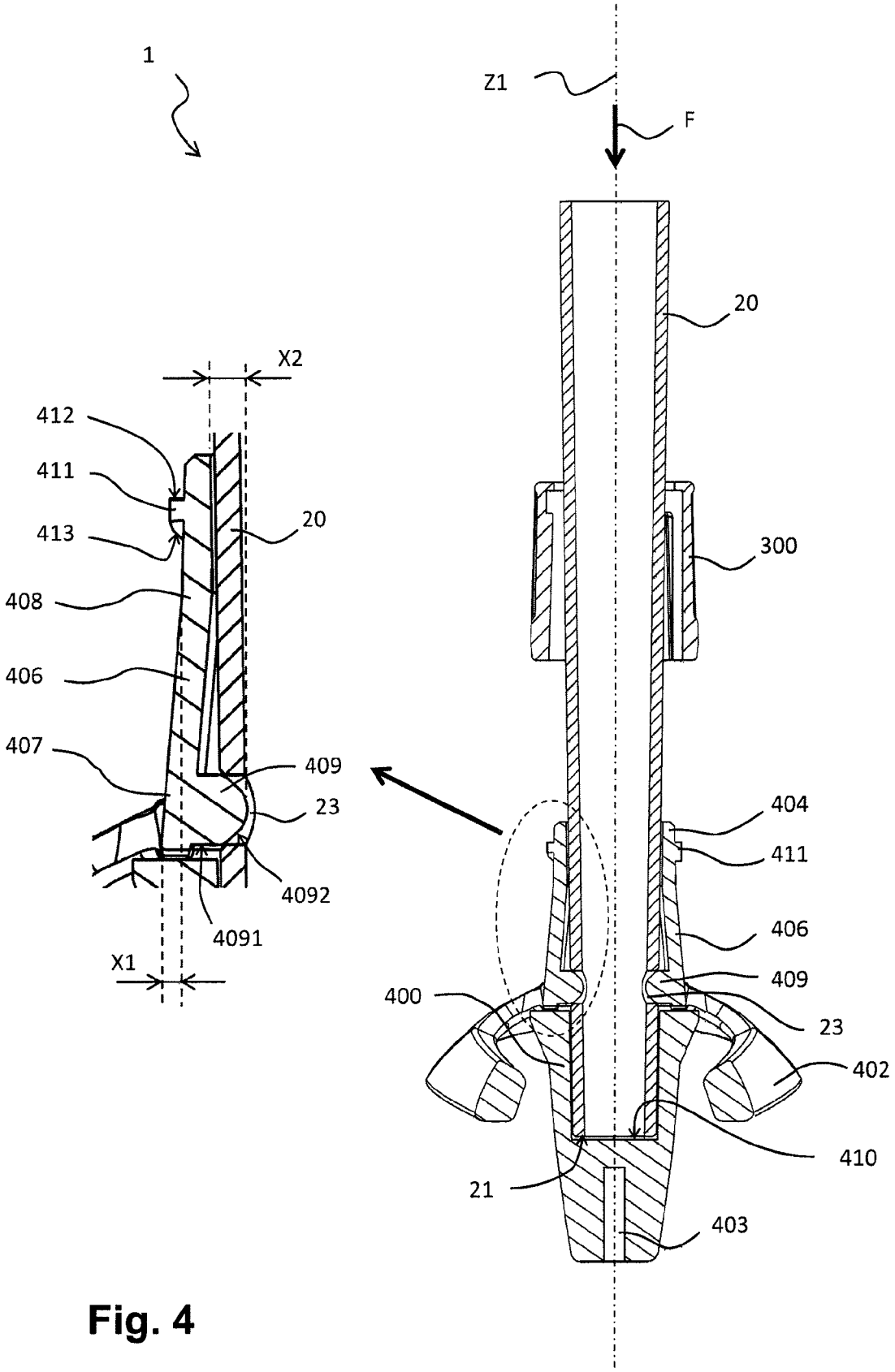
FIG. 4 is a cross-sectional view of the elements illustrated in FIG. 1, showing the shaft inserted into the basket and indexed in relation thereto, the ring not being assembled on the basket.

Next, the basket 400 is positioned, such as shown in FIG. 4. For this, the distal end portion 22 of the shaft 20 is inserted into the basket 400 until the distal end 21 abuts against the bottom 410 of the housing 401. The basket is then rotated until the nub 409 cooperates with the opening 23 of the shaft.

Next, as shown in FIG. 5, the ring 300 is assembled with the basket 400. This is described in detail below.

To separate the end piece, the reverse steps are performed.

When the ring 300 is positioned on the basket 400, its inner surface 302 limits the radial displacement of the second end 408 of the catch 406 outward of the housing 401. In the illustrated embodiment, in the assembled position, shown in FIG. 5, the ring 300, via its inner surface 302, presses the catch 406 flat against the shaft 20 and prevents any radial movement of these elements in relation to the shaft 20.

The pole 1 is shaped so that the cooperation of the nub 409 and the opening 23 opposes any longitudinal force which tends to separate the basket 400 from the shaft 20. The nub 409 thus forms an axial stop in the opening 23 to prevent this separation. The nub 409 then remains inserted in its opening 23 and the affixation of the basket 400 in relation to the shaft 20 is ensured.

In this example, the nub 409 also has at least one lateral stop surface 4091, extending about the longitudinal direction Z1. In a particular embodiment the nub can have two such lateral rotational stop surfaces. Here, a lateral surface refers to a lateral portion of the outer surface forming the cylindrical portion 4091. Each lateral rotational stop surface is configured to come into contact with an edge of the opening 23 of the shaft 20, into which the nub is inserted. Thus, a rotational stop surface forms a stop preventing rotation in one direction of the end piece about the shaft. This makes it possible to angularly or rotationally index the end piece 30, including the basket 400, in relation to the shaft 20. The nub 409, then, is at least part of such indexing mechanism to fix the shaft against rotation in relation to the basket.

Furthermore, advantageously, the basket 400 is configured such that, when a catch 406 is not biased, a portion of the nub 409 penetrates within the housing 401 by a radial distance X2 which is referred to as the indexing height. This distance is less than 3.0 mm in a particular embodiment. Similarly, in this embodiment, only the nub head 4092 projects within the housing 401; the cylindrical portion 4091 remains outside the housing 401. Thus, the indexing height X2 is substantially equal to the height H2 of the nub head. Consequently, when the basket 400 is mounted on the shaft 20, only the nub head 4092 is engaged in the opening 23. According to an embodiment, the indexing height X2 is less than the height H2, which makes it easier to disengage the nub 409 from the opening 23. This feature is clearly shown in FIG. 4, the basket 400 being shown to be properly positioned on the shaft 20, the ring 300 not being positioned on the basket 400.

According to an embodiment, the catch 406 is elastic. Thus, when the shaft 20 is inserted into the housing 401, the outer surface of the shaft 20 comes into contact with the nub 409, and if insertion continues, the catch 406 is caused to bend. Therefore, the catch 406 is constrained and exerts a force on the outer surface of the shaft 20, in the area of the nub 409. This force corresponds to the restoration of the bending force. However, when the basket 400 is positioned so that the nub 409 is opposite the retaining surface 23, the nub 409 at least partially engages in the retaining surface 23. The catch 406 returns to a stable rest configuration in which it is no longer constrained, as shown in FIG. 4. In this stable rest configuration of this embodiment, only the nub head 4092 is engaged in the opening 23; the cylindrical portion 4091 is not engaged.

The user can then perceive, for example visually, by sound, or by sensation at the fingertips, when the nub 409 is properly positioned. According to an embodiment, the nub is sufficiently inserted into the retaining surface opening 23 to form a stop configured to retain the basket on the shaft, even under the effect of their respective weights. It is notable that at this stage, this cooperation is not sufficient to ensure the desired connection between the basket and the shaft during use. This is a pre-assembly configuration necessary for locking of the end piece properly.

The catch 406, when not biased, i.e., in its rest position, projects on the outer envelope of the wall 404 demarcating the housing 401. Consequently, the first end 407 of the catch is spaced from the outer envelope of the wall 404 by a radial distance X1 which is referred to as the actuating height. Thus, simply by positioning the ring 300 on the wall 404, the inner surface of the ring 300 comes into contact with the catch 406 and pushes it inward of the housing 401, causing the catch 406 to bend. Consequently, the catch 406 is then constrained and exerts an inward force on the inner surface of the ring 300, in the area of the end 407. This force corresponds to the restoration of the bending force. The nub 409 is therefore pushed inward of the retaining surface 23 when the latter is arranged at right angles with the nub 409. In this configuration, i.e., an assembled configuration, the cylindrical portion 4091 may then engage in the opening 23. In the example, the actuating height X1 is substantially equal to the height H1 of the cylindrical portion 4091 of a nub 409 so that, when the ring acts on a catch 406, the cylindrical portion 4091 engages in the retaining surface opening 23 of the shaft 20. Thus, the penetration of the nub 409 into the opening 23 is then sufficient to ensure the desired affixation between the basket and the shaft during use. Indeed, the cylindrical portion 4091 substantially contributes to the axial retention and the rotational affixation. In this configuration, as shown in FIG. 5, the end of the nub 409 penetrates within a housing 401 by a radial distance X3 which is referred to as the locking height. This radial distance is substantially equal to the total height H of the nub 409, or the sum of the heights H1 and H2. It corresponds substantially to the sum of the actuating height X1 and the indexing height X2. In the case in which the shaft 20 is tubular, the height H1 of the cylindrical portion 4091 of a nub 409 may be at least equal to the thickness of the tube in the area of the opening 23.

In order for the indexing to be carried out correctly, the actuating height X1 is less than the height H of the nub 409; in a particular embodiment, it is even less than half the height H. According to a well-functioning embodiment, the height H1 is substantially equal to the height H2. Similarly, according to this embodiment, the height of the nub is less than 4.0 mm.

Thus, the axial position of the basket 400 on the shaft 20 is ensured, along a direction Z1 by the cooperation of the axial stop 410 and the distal end 21 of the shaft 20, and along the reverse direction by the cooperation of the nub 409 with the complementary retaining surface opening 23. Furthermore, the angular position of the basket 400 in relation to the shaft 20 is ensured by the cooperation of the nub 409 with the complementary retaining surface opening 23.

The invention thus makes it possible to position the end piece in relation to the shaft 20 both axially and angularly, in a particularly simple and precise manner. However, the angular positioning can be particularly important, in particular when the angular orientation of the handle must be adapted to that of the end piece. This is especially the case in cross-country skiing, the member configured to penetrate into the ground being inclined in relation to the longitudinal direction Z1.

In addition to being particularly simple and accurate, this solution to achieve the orientation has the advantage of being more robust and more reliable than known solutions, which involve achieving the angular indexing by cooperation of the end piece with a specific shape carried by the distal end 21 of the shaft 20. Indeed, in the development context of the present invention, it was found that the distal end 21 of the shaft 20 can be covered with soil or snow during use, rendering inoperative a cooperation based on the shape of the distal end 21 of the shaft 20. In addition, this distal end 21 is generally subject to impacts that quickly deteriorate its shape. By providing to offset the indexing mechanism at a distance from the distal end 21 of the shaft 20, the invention thus increases the robustness and reliability of the rotational indexing. The indexing mechanism 409/23 is thus better protected because it is less exposed to impacts.

To separate the basket 400 from the shaft 20, it is necessary to remove the ring 300 from the basket 400 in order to release the catch 406. After removal of the ring, the catch 406 returns to a stable rest configuration in which it is no longer constrained, as shown in FIG. 4. In this new configuration, as explained above, the nub 409 is still partially housed in the opening 23. This results in a partial automatic disengagement. However, the nub 409 is less engaged in the opening 23. In this exemplary embodiment, only the nub head 4092 is engaged when the ring 300 is removed. However, the shape of the nub head can be configured to facilitate the bending of the catch 406 in order to allow complete disengagement of the nub 409 from the opening 23, simply by displacing the basket 300 in relation to the shaft 20. Suitable shapes include, for example, a spherical portion, a cone, or a pyramid.

This embodiment is particularly advantageous because the basket 400 can be affixed to the shaft 20 in a particularly simple and reliable manner. Indeed, only the removal of the ring 300 permits this separation.

As mentioned above, the catch 406 can be elastic and such elasticity enables the nubs 409 to be radially displaced outward of the housing 401 when the ring 300 is removed from the basket 400. Thus, during unlocking, the ring 300 is removed from the basket 400 and the nub 409 disengages automatically, at least partially, from the retaining surface, that is, from the opening 23. The removal of the shaft 20 from the housing 401 is then facilitated. The invention thus makes it possible to simplify the removal of the end piece from the shaft 20.

According to an embodiment, the catch 406 extends longitudinally, the second end 408 connected to the wall 404 being positioned upstream of the first end 407 carrying the nub 409. Upstream and downstream are defined with respect to the direction F of the translatory component of the insertion of the ring 300 onto the basket 400. In other words, the second end 408 is fixed to the upper portion of the wall 404 when the axis of the basket is vertical, the housing 401 oriented upward. The first end 407 is then located in the lower portion of the wall 404. Furthermore, because the second end 408 of the catch 406 is farther from the longitudinal axis than the first end 407, this configuration enables the second end 408 to be progressively bent inward of the housing 401 as and when the ring 300 is inserted onto the basket 400. This configuration makes it possible to prevent the rupture of the catch 406 due to a rough insertion of the ring 300 onto the basket 400, which rupture would be more likely with a reverse configuration in which the first end 407 of the catch 406 is positioned upstream from the second end 408.

Similarly, this positioning downstream from the first end 407 of the catch 406 facilitates the insertion of the shaft 20 into the housing 401 without the risk of the distal end 21 of the shaft 20 damaging the catch 406 while the nub 409 projects within the housing 401. Indeed, the shaft 20 gradually pushes the catch 406 outward of the housing 401 as and when it is inserted into the housing 401.

In addition, the end piece comprises axial locking mechanism configured to eliminate or limit the axial displacement between the basket 400 and the ring 300. The axial locking mechanism makes it possible to prevent unintentional axial spacing of the ring 300 in relation to the basket 400, which could lead to a separation of the end piece from the shaft 20.

In the example, the axial locking mechanism is shaped so as to be activated by a relative rotation about the longitudinal direction Z1 between the ring 300 and the basket 400. According to one particular embodiment, the axial locking mechanism comprises at least one inclined surface 305, 413 in relation to a direction perpendicular to the longitudinal direction Z1, this inclined surface 305, 413 being carried by one of the ring 300 or the basket 400, and being configured to cooperate with a complementary surface carried by the other of the ring 300 or the basket 400 so as to convert the rotation of the ring 300 into a translation of the latter towards the cup 402. Thus, when the user performs a rotation of the ring 300 on the basket 400 in a locking direction, the ring 300 is pushed towards the cup 402, and when the user performs a rotation in the opposite direction, the ring 300 moves away from the cup 402.

The inclined surface thus serves as a cam profile. As can be seen in particular in FIGS. 1 and 3 of the illustrated embodiment, the basket 400 has a first inclined surface 413 carried by a relief 411 formed on an outer surface of the wall 404 defining the housing 401. This first inclined surface 413 forms a screw thread or a screw thread portion. The ring 300 has a second inclined surface 305 complementary to the first inclined surface 413. The second inclined surface 305 is carried by a projection 306 carried by the inner surface 302 of the opening 301. The first and second inclined surfaces 413, 305 are shaped to convert a relative rotational movement between the ring 300 and the basket 400 into a relative translational movement.

In the exemplary embodiment, the axial locking mechanism is shaped so that locking is achieved by rotating the ring 300 by an angle less than 180° in a locking direction. In a particular embodiment, this angle is less than or equal to 90°. In the exemplary illustrated embodiment, the angle is about 60°. The locking and unlocking are thus obtained very quickly and easily. The invention thus improves upon known solutions in that it avoids a long and tedious screwing, which is a source of inaccuracies.

Therefore, the connection of the ring 300 to the basket 400 is carried out by first performing a relative translation of the ring 300 in relation to the basket 400 on a stroke corresponding, for example, to a portion of the longitudinal dimension of the housing 401, and then by performing a rotational movement to complete the relative translation between these two elements, until reaching the stop.

Figure 2:
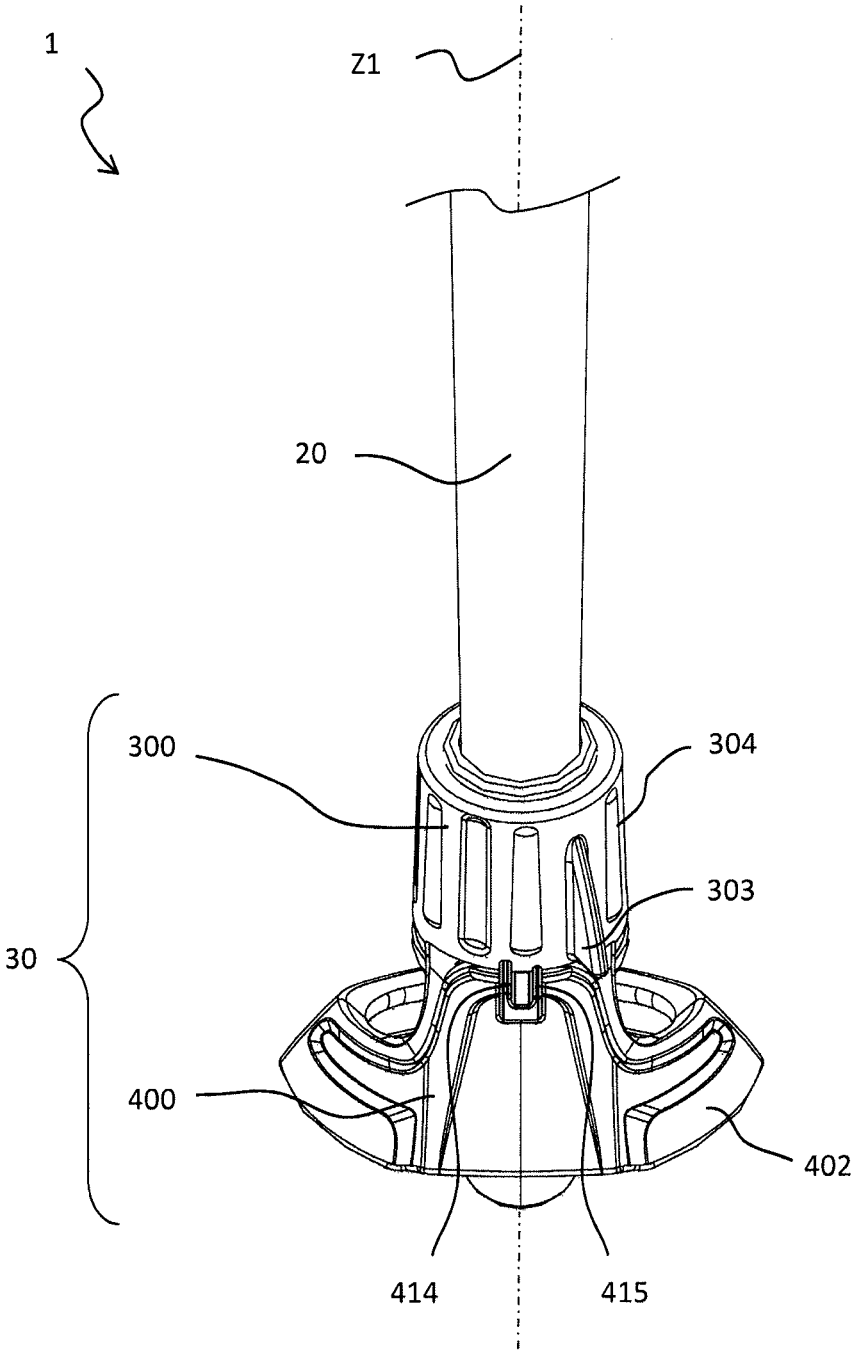
FIG. 2 is another perspective view of the three elements illustrated in FIG. 1, these three elements being affixed to one another.
Figure 3:
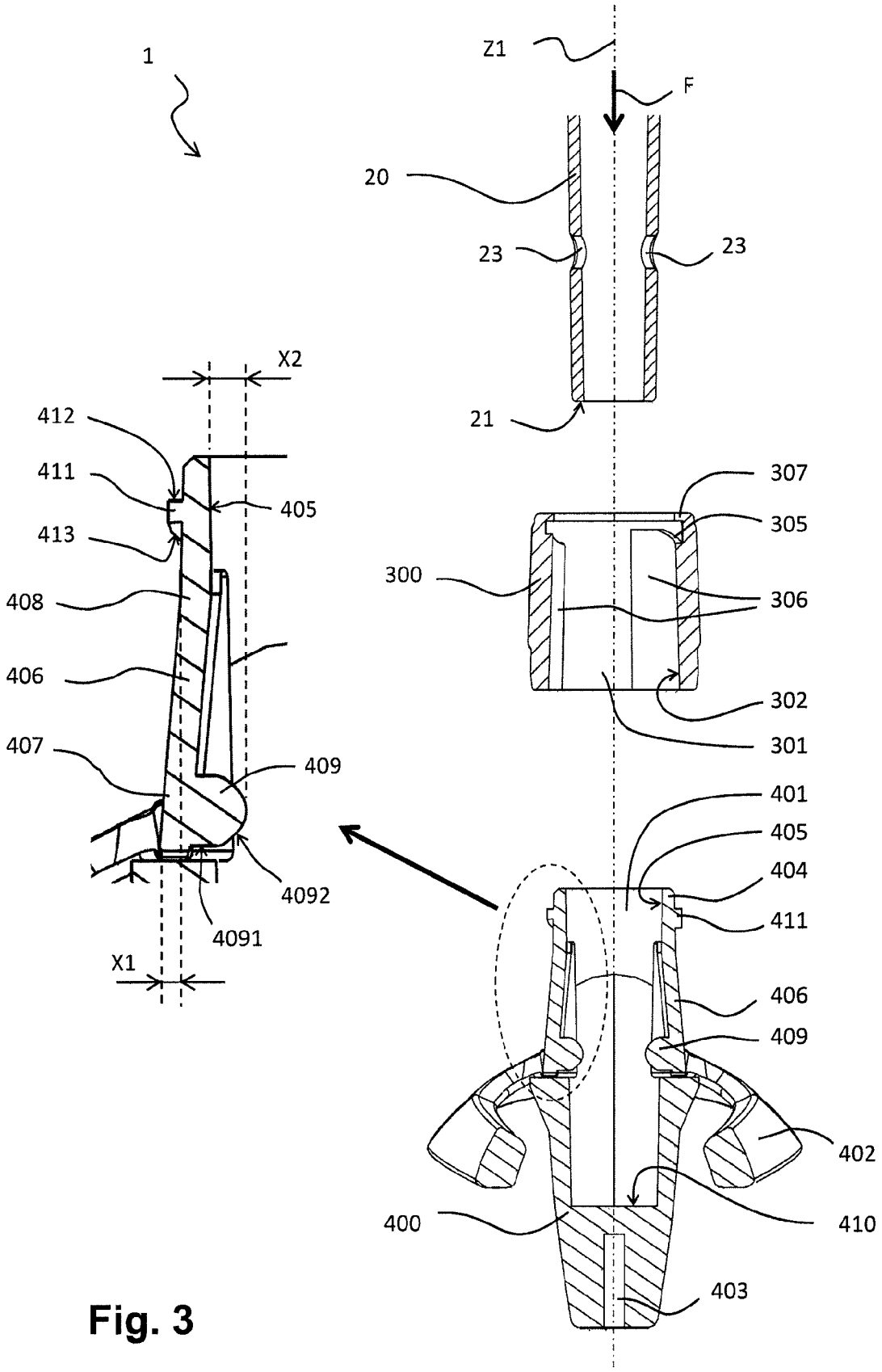
FIG. 3 is a cross-sectional view of the elements shown in FIG. 1, the shaft, the ring, and the basket being separated.

In the exemplary embodiment, the rotation of the ring 300 in the locking direction is limited by a rotational stroke limit stop 414, for example carried by the basket 400 in the area of the cup 402. This stop is shown in FIG. 2. The ring 300 may be arranged to facilitate the manipulation, especially when the user is wearing gloves and/or the pole is wet. The outer surface of the ring is knurled, for example. These gripping reliefs may take the form of longitudinally extending ribs 304 distributed over the circumference of the ring 300. The ring 300 may also be provided with a gripping zone 303 shaped to provide support for a finger sliding against the periphery of the ring. The ring 300 is sized so that, at the stroke limit, the gripping zone 303 abuts on the stoke limit stop 414. Due to the stop 414, in addition to facilitating the locking, the invention makes it possible to ensure that the ring is correctly mounted on the basket, so that the axial locking mechanism is functional. Furthermore, this reduces the risk of damage to the constituent elements of the end piece. Typically, the gripping zone 303 has a fin shape. For example, it has ergonomics that promote handling by a thumb or other finger of the user. The invention thus provides a solution for locking and unlocking the ring 300 on the basket 400 in a simple, efficient, and quick manner.

According to an embodiment, a reference mark is provided on the ring 300 so as to coincide with a complementary reference mark carried by the basket 400. When the ring 300 is locked on the basket 400, the two reference marks cooperate. In this case, the ring 300 and the basket 400 are axially affixed to one another. The ring is arranged with respect to the basket, in a stable predetermined configuration so as to act on the catches 406 to maintain cooperation between the nubs 409 and the retaining surfaces 23, thus ensuring the affixation between the end piece 30 and the shaft 20. In other words, the ring 300 is configured to limit the radial displacement of the first end 407 of the catch 406 outward of the housing 401. The user can easily check that the ring 300 is properly locked. These reference marks can be visual and/or tactile. For example, the shape and/or color of the gripping zone 303 and of the stroke limit stop 414 may be selected so that their cooperation is readily identifiable in a visual and/or tactile manner. In the illustrated example, the reference mark corresponds to the gripping zone 303 and the complementary reference mark corresponds to the stroke limit stop 414. Thus, when the gripping zone comes into contact with the stroke limit stop, the ring 300 is arranged in relation to the basket in a stable predetermined locking configuration. In this example, the axial locking mechanism is operative when the ring is in this locking configuration.

The basket 400 may also include rotational locking mechanism configured to prevent, limit, or at least oppose an accidental rotation of the ring 300 from the locked position. In the exemplary illustrated embodiment, the rotational locking mechanism comprises a flange 415 or connection piece carried by the basket 400. This flange 415 is illustrated in FIG. 2 and forms an obstacle positioned on the rotational stroke of the ring 300. It is sized to be crossed by the fin 303 when the user manipulates the latter in the locking or unlocking direction. In contrast, in the absence of manipulation applied by the user to the fin or to the ring 300, the dimensions of the flange prevent the fin 303 from being crossed. Thus, in the locked position, even if the pole 1 vibrates, the flange 415 prevents the ring 300 from rotating, thereby preventing unintentional unlocking of the end piece. The retention reliability of the end piece is thus further reinforced. Furthermore, the invention facilitates the locking or unlocking of the end piece while avoiding the drawbacks of the known systems.

The end piece may include an angular indexing mechanism configured to allow insertion of the ring 300 onto the basket 400 via axial translation only for a specific angular orientation or only for a specific range of angular orientations between these two elements. Thus, the user can slide the ring 300 on the basket 400 only if the ring 300 is properly positioned angularly in relation thereto. This facilitates subsequent actuation of the axial or rotational locking mechanism. In the example shown, the indexing mechanism comprise projections 306 formed within the opening of the ring 300 and reliefs 411 carried by the inner surface 405 of the housing 401 of the basket 400. According to a particular embodiment, these reliefs 411 also carry the first inclined surfaces 413 of the axial locking mechanism, and the projections 306 also carry the second inclined surfaces 305 of the axial locking mechanism. The sliding of the ring 300 on the basket 400 is possible only when the projections 306 are not at right angles with reliefs 411 along the longitudinal direction Z1. If the projections 306 are at right angles with of the reliefs 411, along an axial direction Z1, they abut on the latter, thereby preventing the connection of the ring 300 to the basket 400.

Therefore, the projections 306 must be positioned so as to face grooves that are demarcated by two reliefs 411 in order to be able to insert the ring. In the example, the 411 reliefs, like the projections 306, are three in number and distributed in a circle. In a particular embodiment, first and second reliefs 411 form an angle of 90°, and a third relief forms an angle of 120° with the first relief 411 and an angle of 150° with the second relief 411. The projections 306 are also distributed along this configuration. The reliefs 411 and projections 306 thus serve as a fool-proofing device for the connection of the ring 300 to the basket 400. Alternatively, the number of reliefs and projections is different.

According to an embodiment, the ring 300 and the basket 400 include visual reference marks configured to cooperate so as to indicate a particular angular positioning of the ring 300 in relation to the basket 400 about the axis Z1. This particular angular positioning may be the one for which the angular indexing mechanism is configured to allow insertion of the ring 300 onto the basket 400.

Advantageously, the ring 300 comprises a collar 307 bordering the upper end of the ring and extending inward of the opening 301. The collar 307 prevents or limits penetration of foreign matter, such as snow, ice, or mud, within the ring, between the ring and the basket. This protection ensures proper functioning of the mechanism for indexing the basket in relation to the shaft and of the mechanism for locking the ring with the basket. Indeed, ice, packed snow, or mud can disrupt the functioning of these mechanisms by blocking the moving parts. In addition, the collar 307 can serve as an axial stop for the reliefs 411 when positioning the ring on the basket.

Figure 8:
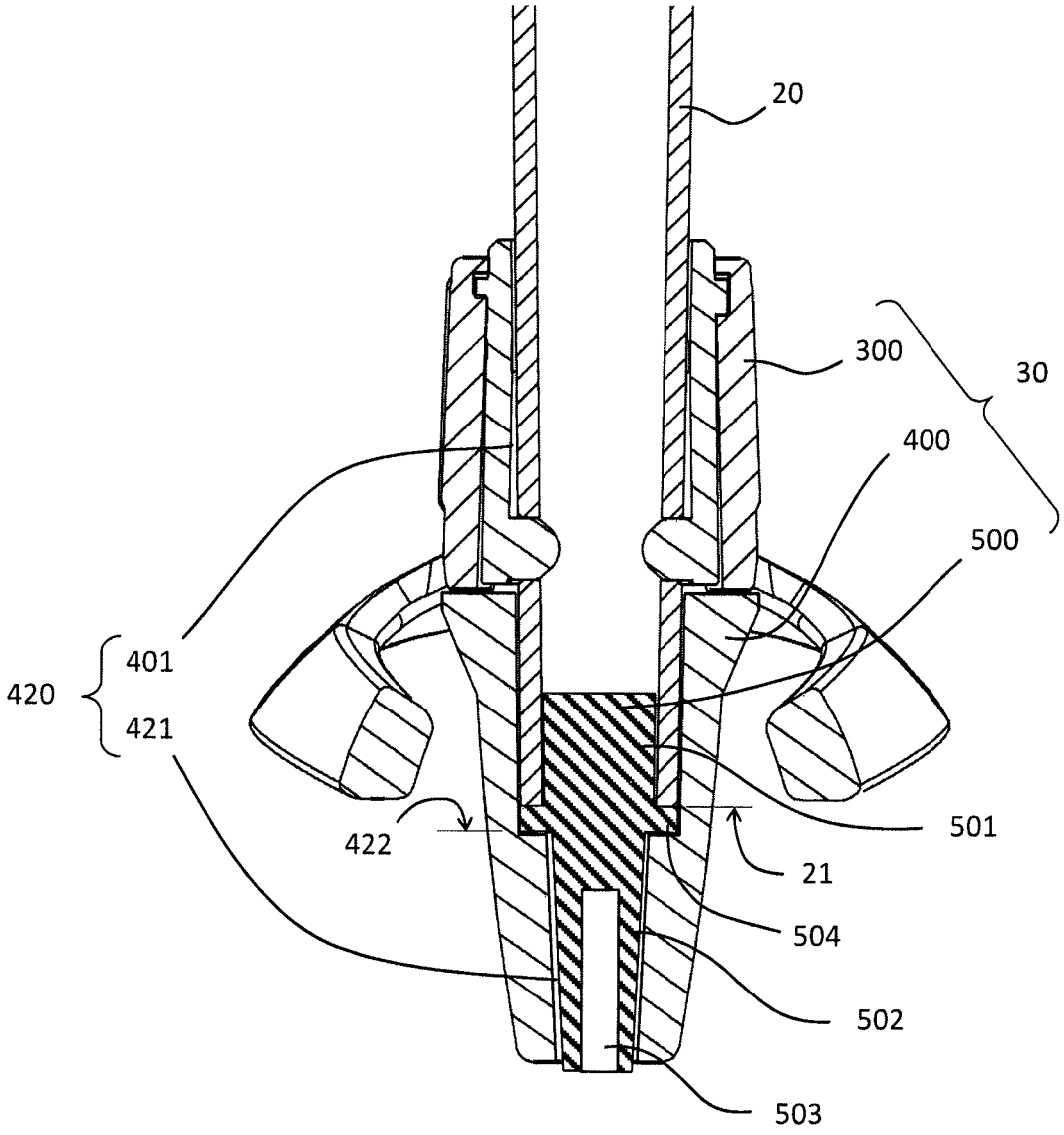
FIG. 8 is a cross-sectional view, similar to FIG. 5, of another embodiment.

FIG. 8 illustrates another embodiment. The system for affixing the basket 400 to the shaft 20 is identical to the embodiment described above.

The difference lies in the fact that the basket 400 includes a through hole 420 extending longitudinally through the element. This hole 420 thus opens out on both sides of the basket, along its longitudinal axis. In its upper portion, the hole 420 is formed by the housing 401. In its lower portion, the hole 420 is formed by a second housing 421, which opens out into the lower portion of the basket 400. The second housing 421 extends the housing 401. In this example, the second housing 421 is slightly conical, the largest diameter being located within the basket 400, in the area of the junction between the housing 401 and the second housing 421. The second housing 421 is dimensioned such that its largest diameter is smaller than the diameter of the housing 401 in order to create a flange forming an upper annular surface 422.

In this example, the end piece 30 includes the ring 300 but also a tip 500, inserted within the shaft 20 and interposed between the shaft 20 and the basket 400. The tip 500 comprises a cylindrical upper portion 501 having a diameter substantially equal to or slightly smaller than the inner diameter of the shaft 20 in order to be inserted into the shaft. The tip 500 also comprises a lower portion 502 of which the outer envelope is configured to conform to the shape of the second housing 421. Between its upper portion 501 and its lower portion 502, the tip comprises a collar 504 whose outer diameter, in a particular embodiment, is substantially equal to the outer diameter of the distal end 21 of the shaft 20. The tip 500 further comprises a cavity 503 for receiving an end member, as in the embodiment described above.

When the end piece 30 is assembled, the distal end 21 of the shaft 20 is configured to be in contact with the collar 504, and the latter is configured to be in contact with the upper annular surface 422 of the basket 400. This construction enables good transmission of thrust force, from the shaft to the basket and also from the shaft to the end member.

Due to this construction, the end member can be provided to be attached independently of the basket. This is advantageous because the basket or the end member can be changed independently, if damaged. In this exemplary illustrated embodiment the basket can be dismounted without removing the end member. This may be advantageous for switching between use in summer, without the basket, and use in winter, with the basket.

Advantageously, an angular indexing mechanism may be provided between the tip 500 and the basket 400 and/or between the tip 500 and the shaft 20. For example, it may be a notch in the collar 504 cooperating with a nub projecting from the upper annular surface 422 of the basket 400.

A retaining mechanism may also be provided for affixing the tip 500 and the basket 400 and/or for affixing the tip 500 and the shaft 20. This can facilitate the assembly of the end piece on the pole.

The foregoing embodiments include an end piece attached to the distal end of a pole shaft. This distal end of a pole shaft should be interpreted broadly. The invention thus also covers an end piece fixed to an element attached to the distal end of a pole shaft, since the end piece reproduces the same connection system. In this case, it is the attached element that constitutes the distal end of a pole shaft, which is inserted into the housing 401 of the basket 400.

The foregoing description clearly demonstrates that the invention offers a solution that facilitates the assembly of the end piece onto the shaft 20, while improving the reliability and robustness of the assembly, as well as the proper axial and angular positioning of the end piece in relation to the shaft 20.

The invention, although particularly advantageous in the context of cross-country skiing, as it makes it possible to withstand substantial thrust forces, is not limited to this application and extends to ski poles in other winter sports (alpine skiing, touring ski, snowshoeing in particular), as well as to poles intended for walking, hiking, or trail running.

The invention is not limited to the aforementioned embodiments. It is possible to combine the embodiments.

Moreover, the invention is not limited to the embodiments described above and extends to all embodiments covered by the claims.

Further, at least because the invention is disclosed herein in a manner that enables one to make and use it, by virtue of the disclosure of particular exemplary embodiments of the invention, the invention can be practiced in the absence of any additional element or additional structure that is not specifically disclosed herein.

The invention claimed is:

1. An end piece for a pole comprising:

a basket comprising a housing configured to receive a distal end of a shaft of the pole;

a locking ring configured to be assembled to the basket and to surround at least a portion of the housing;

the housing of the basket being demarcated by a wall;

at least one catch supported by the wall of the housing, each said one catch comprising:

a first end;

a nub projecting from the first end of the catch, the nub being configured to extend to within the housing;

each nub designed to cooperate with a retaining surface of the shaft so as to index in rotation the basket in relation to the shaft;

the catch being structured and arranged to assume any of a plurality of configurations corresponding to various radial positions of the nub;

the locking ring being shaped to limit radial displacement of the first end of the catch outward of the housing when the locking ring is assembled to the basket.

2. An end piece according to claim 1, wherein:

the wall defines an outer envelope;

when at rest, the first end of each catch projects outward from the outer envelope of the wall.

3. An end piece according to claim 1, wherein:

when at rest, each nub projects within the housing by a height less than 3.0 mm.

4. An end piece according to claim 1, wherein:

the end piece is configured so that, when the locking ring is assembled to the basket, the locking ring presses on each catch to radially displace the first end of each catch inward of the housing.

5. An end piece according to claim 1, wherein:

each said catch is elastic;

the basket is dimensioned such that each nub returns outward of the housing under the effect of the elasticity of the catch when the locking ring is removed from the basket.

6. An end piece according to claim 1, wherein:

the end piece comprises an axial locking mechanism configured to limit relative axial displacement between the basket and the locking ring;

activation of the axial locking mechanism comprises a relative rotation between the basket and the locking ring.

7. An end piece according to claim 6 wherein:

the axial locking mechanism is configured to provide axial locking via a relative rotation, having an angle less than 180°, between the locking ring and the basket.

8. An end piece according to claim 1, wherein:

the end piece comprises a rotational locking mechanism for limiting the relative rotation between the basket and the locking ring when the end piece is assembled.

9. An end piece according to claim 1, further comprising:

an angular indexing mechanism for positioning the locking ring on the basket via relative axial translation between the locking ring and the basket only for one or predetermined angular orientations between the two elements.

10. An end piece according to claim 1, wherein:

each said one catch further comprises a second end opposite the first end, each said second end being arranged on the wall downstream along a direction of insertion of the distal end of the shaft into the housing.

11. An end piece according to claim 1, wherein:

the wall of the housing forms a closed ring in an area of the end of the housing downstream along a direction of insertion of the distal end of the shaft into the housing.

12. An end piece according to claim 1, wherein:

the housing forms a portion of a hole extending through the basket along a longitudinal axis of the basket.

13. An end piece according to claim 1, wherein:

the locking ring comprises a reference mark;

the basket comprises a complementary reference mark;

the reference mark and complementary reference mark are arranged such that, when they cooperate, the locking ring is configured to limit a radial displacement of the first end of the catch outward of the housing.

14. An end piece according to claim 1, wherein:

the nub of the catch is configured to be free to be moved radially in relation to wall of the housing.

15. An end piece according to claim 1, wherein:

the catch extends within an opening in the wall of the housing.

16. An end piece according to claim 15, wherein:

the nub of the catch is configured to move towards or away from an interior of the housing of the basket through the opening in the wall.

17. An end piece according to claim 1, wherein:

the catch comprises a second end affixed to the wall of the basket and supporting the catch;

the catch being a tongue-shaped catch having a free end and a fixed end, the free end being designed for movement in relation to the fixed end;

the free end of the tongue-shaped catch being the first end and the fixed end of the tongue-shaped catch being the second end.

18. An end piece according to claim 17, wherein:

the fixed end of the catch is an upstream end and the free end of the catch is a downstream end.

19. An end piece according to claim 1, wherein:

the wall of the basket extends around a longitudinal axis and extends longitudinally from a proximal end of the housing to a distal end;

the proximal end of the housing forms a continuous ring for receiving a distal end portion of a shaft of the pole.

20. An end piece according to claim 19, wherein:

the continuous ring has a continuous upper edge for receiving the distal end portion of the shaft of the pole.

21. An end piece according to claim 1, wherein:

the catch further comprises a second end, the first end being longitudinally spaced from the second end;

the nub is at the first end of the catch and is downstream of the second end of the catch.

22. An end piece according to claim 1, wherein:

the catch is part of both an axial-pole-locking mechanism and an angular-pole-indexing mechanism to fix the pole both axially and angularly with respect to the end piece.

23. An end piece according to claim 22, wherein:

an entirety of the catch is upstream from a downstream end of the basket.

24. An end piece according to claim 1, wherein:

the catch is configured for movement between two of the plurality of configurations, said two comprising:

a pre-assembly configuration in which the ring is not assembled to the basket and in which a portion of the catch is outside the wall of the basket; and an assembled configuration in which the ring is assembled to the basket and in which the nub of the catch is positioned more radially inward than in the pre-assembly position.

25. An end piece according to claim 1, wherein:

the retaining surface of the shaft that cooperates with the nub is a hole or a recess.

26. An end piece according to claim 1, wherein:

the at least one catch comprises at least two catches arranged symmetrically in relation to a longitudinal axis of the housing.

27. An end piece according to claim 1, wherein:

each nub comprises a lateral rotational stop surface designed to engage the retaining surface of the shaft to block rotation of the basket in relation to the shaft.

28. A pole comprising:

a shaft;

the shaft being equipped with at least one end piece, the end piece comprising:

a basket comprising a housing configured to receive a distal end of a shaft of the pole;

a locking ring configured to be assembled to the basket and to surround at least a portion of the housing;

the housing of the basket being demarcated by a wall;

at least one catch supported by the wall of the housing, each said one catch comprising:

a first end;

a nub projecting from the first end of the catch, the nub being configured to extend to within the housing;

each nub designed to cooperate with a retaining surface of the shaft so as to index in rotation the basket in relation to the shaft;

the catch being structured and arranged to assume any of a plurality of configurations corresponding to various radial positions of the nub;

the locking ring being shaped to limit radial displacement of the first end of the catch outward of the housing when the locking ring is assembled to the basket.

29. A pole according to claim 28, wherein:

the catch is configured for movement between two of the plurality of configurations, said two comprising:

a pre-assembly configuration in which the ring is not assembled to the basket and in which a portion of the catch is outside the wall of the basket; and an assembled configuration in which the ring is assembled to the basket and in which the nub of the catch is positioned more radially inward than in the pre-assembly position.

30. A pole according to claim 29, wherein:

the shaft comprises at least one retaining surface; and in the pre-assembly configuration of the shaft, and with a distal end portion of the shaft positioned within the housing of the basket, the nub of the catch is in engagement with the at least one retaining surface of the shaft.

31. A pole according to claim 30, wherein:

in the pre-assembly configuration of the shaft, and with a distal end portion of the shaft positioned within the housing of the basket, the shaft is restrained by the engagement with the at least one retaining surface of the shaft against movement both axially and angularly with respect to the basket.

32. A pole according to claim 28, wherein:

the retaining surface of the shaft that cooperates with the nub is a hole or a recess.

33. A pole according to claim 28, wherein:

the at least one catch comprises at least two catches arranged symmetrically in relation to a longitudinal axis of the housing.

34. A pole according to claim 28, wherein:

each nub comprises a lateral rotational stop surface designed to engage the retaining surface of the shaft to block rotation of the basket in relation to the shaft.

35. A ski pole for use during skiing, said ski pole comprising:

a shaft structured and arranged to receive a skier-generated pushing force against the ground during skiing;

the shaft being equipped with at least one ground-engaging end piece, the end piece comprising:

a basket comprising a housing configured to receive a distal end of a shaft of the pole;

a locking ring configured to be assembled to the basket and to surround at least a portion of the housing;

the housing of the basket being demarcated by a wall;

at least one catch supported by the wall of the housing, each said one catch comprising:

a first end;

a nub projecting from the first end of the catch, the nub being configured to extend to within the housing;

each nub designed to cooperate with a retaining surface of the shaft so as to index in rotation the basket in relation to the shaft;

the catch being structured and arranged to assume any of a plurality of configurations corresponding to various radial positions of the nub;

the locking ring being shaped to limit radial displacement of the first end of the catch outward of the housing when the locking ring is assembled to the basket.

* * * * *